United States Patent [19]

Kitabatake

[11] Patent Number: 4,758,490

[45] Date of Patent: Jul. 19, 1988

[54] MAGNETIC COLOR TONER FOR ELECTROPHOTOGRAPHIC COPYING MACHINE

[75] Inventor: Yasuo Kitabatake, Nara, Japan

[73] Assignee: Sharp Kabushiki Kaisha, Osaka, Japan

[21] Appl. No.: 70,163

[22] Filed: Jul. 2, 1987

Related U.S. Application Data

[63] Continuation of Ser. No. 797,659, Nov. 13, 1985, abandoned.

[30] Foreign Application Priority Data

Nov. 13, 1984 [JP] Japan ..... 59-172896[U]

[51] Int. Cl.[4] ..... G03G 9/08; G03G 9/14

[52] U.S. Cl. ..... 430/106; 430/106.6; 430/111; 430/903

[58] Field of Search ..... 430/106, 106.6, 111, 430/903; 252/62.53, 62.54, 62.56

[56] References Cited

U.S. PATENT DOCUMENTS

| | | | |
|---|---|---|---|
| 3,345,294 | 10/1967 | Cooper | 430/106.6 X |
| 4,199,614 | 4/1980 | Ziolo | 430/111 |
| 4,495,268 | 1/1985 | Miyakawa | 430/106.6 X |

FOREIGN PATENT DOCUMENTS

| | | | |
|---|---|---|---|
| 54-2131 | 1/1979 | Japan | 430/403 |
| 55-583 | 1/1980 | Japan | 430/106.6 |
| 2067777 | 7/1981 | United Kingdom | 430/106.6 |

*Primary Examiner*—Roland E. Martin

*Attorney, Agent, or Firm*—Birch, Stewart, Kolasch & Birch

[57] ABSTRACT

Color magnetic toner particles suitable for an electrophotographic copying machine comprise magnetic particles whose diameter is selected less than about 200 angstroms, a coloring agent and a binding agent. Because of the fineness of the magnetic particles, the transparency of the toner particles becomes so good that the color emitted by the coloring agent becomes clear and vivid.

2 Claims, 1 Drawing Sheet

MAGNETIC COLOR TONER FOR ELECTROPHOTOGRAPHIC COPYING MACHINE

This application is a continuation of application Ser. No. 797,659 filed on Nov. 13, 1985, now abandoned.

BACKGROUND OF THE INVENTION

The present invention relates to toner particles for an electrophotographic copying machine and, more particularly, to the structure of color and magnetic toner particles suitable for an electrophotographic copying machine.

In a conventional electrophotographic copying machine, an electrostatic latent image formed on a photoreceptor can be visualized with toner particles. The visual image is then transferred onto a copy paper and fixed. As the toner particles, single-component toners are widely used each comprising a magnetic coloring member and a binding synthetic resin.

In particular, some copying machines can offer the color picture. Conventionally, the color toner of the single-component toner is of the type comprising magnetite or ferrite which is dark or dark brown. Such magnetic particles have a detrimental effect on the color to be developed.

SUMMARY OF THE INVENTION

Accordingly, it is an object of the present invention to provide improved toner particles suitable for an electrophotographic copying machine for ensuring a vivid toner image.

It is another object of the present invention to provide improved color producing magnetic toner particles suitable for an electrophotographic copying machine for ensuring vivid color toner images.

Briefly described, in accordance with the present invention, color and magnetic toner particles suitable for an electrophotographic copying machine are selected to such that the magnetic component is less than about 200 angstroms.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

The single FIGURE is a side view of an electrophotographic copying machine in which the color producing magnetic toner particles of the present invention are utilized to provide a color image.

DETAILED DESCRIPTION OF THE INVENTION

Figure 1:
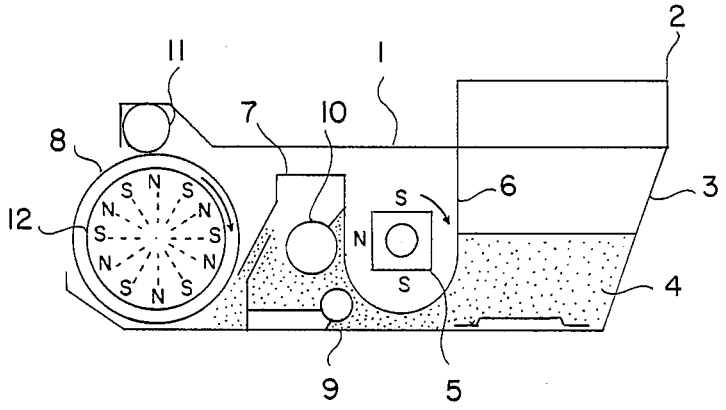

The FIGURE shows a side view of an electrophotographic copying machine to which color and magnetic toner particles of the present invention are applied to provide a vivid color image.

Referring to the FIGURE, the copying machine comprises a developing unit 1, a toner container 3 for containing color magnetic toner particles 4 of the present invention, a toner cartridge 2 selectively coupled to the toner container 3 to supply the amount of the toner particles 4 to the container 3 when the amount therein is reduced or depleted, a toner transport roller 5 rotating to supply the toner particles, a toner supply roller sleeve 6, a magnet roller 12 with twelve poles, and a covering sleeve 8 covering the magnet roller 12.

To copy a document mounted on a document table, the toner transport roller 5 and the magnetic roller 12 are rotated clockwise. In accordance with the rotation of the toner supply or transport roller 5, the toner particles 4 adhere to the supply sleeve 6 and are magnetically transferred to the sleeve 9 by the electromagnetic inducement of the magnet of the toner supply roller 5. With sleeves 9 and 10, the toner particles 4 can be transferred via the opening of a doctor blade 7 to the magnetic roller 12. The magnetic field induced on the outer periphery of the sleeve 8 by the magnetic roller 12 permits the toner particles 4 to be attracted to the surface of the sleeve 8 and transported to the surface of the photoreceptor 11.

PREFERRED EMBODIMENTS

The following TABLE A shows the components in the color and magnetic particles 4 of the present invention according to the first preferred embodiment of the present invention.

TABLE A

COPOLYMER OF STYRENE (about 75%) AND METHYL ACRYLATE (about 25%): about 100 parts
MAGNETITE PARTICLES: about 70 parts
POLYETHYLENE WAX: about 4 parts
COPPER PHTHALOCYANINE BLUE: about 10 parts More particularly, into a copolymer of about 100 parts mixed with styrene of about 75% and methyl acrylate (about 25%) which serves as a synthethic resin for binding the magnetic particles and the coloring agent, the magnetite particles of about 70 parts as the magnetic agent, polyethylene wax of about 4 parts, and copper phthalocyanine blue of about 10 parts as the coloring agent are blended. The mixture is completely blended by a kneader at about 150 degrees Centigrade. After cooling, the mixture is roughly grinded by a hammer mill and finely grinded by a jet mill. A pneumatic classifier is used to select the particles of about 5–20 microns. If desired, a colloidal silica of about 5 wt.% may be added to the selected particles to finally provide the blue, magnetic toner particles.

The following TABLE B shows the components of the toner particles 4 according to the second preferred embodiment of the present invention.

TABLE B

COPOLYMER OF STYRENE AND METHYL METHACRYLATE: about 100 parts
FERRITE MAGNETIC PARTICLES: about 80 parts
POLYETHLYNE WAX: about 5 parts More particularly, into a copolymer of about 100 parts of styrene (about 25%) and methyl methacrylate (about 75%) which acts as the binding agent, the ferrite magnetic particles of about 80 parts as the magnetic agent, polyethylene wax of about 5 parts, and brilliant carmin 6B of about 6 parts as the coloring agent are mixed. Such a mixture is grinded in the same manner as described above to finally provide the red and magnetic toner particles of about 5–20 microns.

According to the present invention, the magnetite and the ferrite particles are selected to be less than about 200 angstroms in diameter with the grinding of the magnetic particles, the growth of the particles in wet settling, the baking of the magnetic particles, the growth of the particles by flux, and vapor deposition. Since the diameter of the color and magnetic particles is less than about 1/20 of the frequency of the visible rays of about 0.4–0.7 microns, the visible rays emitted from the coloring agent mixed with the magnetic particles are prevented from being stopped and absorbed by the particles because such visible rays can easily penetrate the distance between the particles in view of the fineness of the particle diameter. Therefore, the light transparency of the toner particles is remarkably good. The color of the coloring agent in the toner particles therefore becomes vivid. Color bleeding and nonuniformity in the color image produced are eliminated.

If the diameter of the particles is about 1–2 microns, the coloring of the coloring agent becomes poor. It it is in the order of about 4–5 microns, bleeding and nonuniformity in the image produced are found.

While only certain embodiments of the present invention have been described, it will be apparent to those skilled in the art that various changes and modifications may be made therein without departing from the sprit and scope of the present invention as claimed.

What is claimed is:

1. A color magnetic toner particle suitable for use in electrophotography consisting essentially of:

a magnetic particle selected from at least one member of the group consisting of magnetite or ferrite having a diameter of less than about 200 angstroms;

a coloring agent; and a binding agent for binding said coloring agent and said magnetic particle, said binding agent being selected from at least one member of the group consisting of a methyl acrylate or methyl methacrylate styrene copolymer, said toner particle having a particle size of from 5–20 microns, the diameter of said coloring agent and magnetic particle being less than 1/20 the frequency of visible rays of about 0.4–0.7 micron emitted from said coloring agent, the effect being that said visible rays readily escape said toner particle, whereby color of said coloring agent in said toner particle becomes especially vivid.

2. The particle of claim 1, wherein said coloring agent is selected from the group consisting of copper phthalocyanine blue or brilliant carmin 6B.

* * * * *